US006432293B1

(12) United States Patent
Ogata et al.

(10) Patent No.: US 6,432,293 B1
(45) Date of Patent: Aug. 13, 2002

(54) PROCESS FOR COPPER-PLATING A WAFER USING AN ANODE HAVING AN IRIDIUM OXIDE COATING

(75) Inventors: Setsuro Ogata; Kenichi Ueno, both of Kanagawa (JP)

(73) Assignee: Permelec Electrode Ltd., Kanagawa (JP)

( * ) Notice: Subject to any disclaimer, the term of this patent is extended or adjusted under 35 U.S.C. 154(b) by 0 days.

(21) Appl. No.: 09/517,588

(22) Filed: Mar. 3, 2000

(30) Foreign Application Priority Data

Mar. 3, 1999 (JP) ..... 11-055761

(51) Int. Cl.[7] ..... C25D 7/12; C25D 11/32
(52) U.S. Cl. ..... 205/157; 205/292
(58) Field of Search ..... 205/157, 292, 205/123, 125; 204/280, 282, 290.14

(56) References Cited

U.S. PATENT DOCUMENTS 4,469,564 A * 9/1984 Okinaka et al. ..... 205/125
5,143,593 A * 9/1992 Ueno et al. ..... 205/291
5,976,341 A * 11/1999 Schumacher et al. ..... 205/101

* cited by examiner

*Primary Examiner*—Bruce F. Bell
*Assistant Examiner*—Wesley A. Nicolas
(74) *Attorney, Agent, or Firm*—Sughrue Mion, PLLC

(57) ABSTRACT

A process for copper-plating a wafer which comprises electroplating a semiconductor wafer with an electrode comprising a corrosion-resistant metal substrate and a coat mainly composed of iridium oxide provided on the substrate as an anode and the wafer as a cathode in a solution containing copper ion. The anode is preferably an insoluble electrode comprising a corrosion-resistant metal substrate and a coat mainly composed of iridium oxide and further containing a metal or metal oxide selected from platinum, tantalum, titanium, niobium and oxides of these metals provided on the substrate. A neutral membrane or ion exchange membrane may be interposed between the anode and the cathode as a separating membrane.

20 Claims, No Drawings

PROCESS FOR COPPER-PLATING A WAFER USING AN ANODE HAVING AN IRIDIUM OXIDE COATING

FIELD OF THE INVENTION

The present invention relates to a process for copper-plating a wafer which is suitable for forming a copper wiring on a wafer.

BACKGROUND OF THE INVENTION

Copper has a higher allowable current density than aluminum and other metals and thus causes little power loss in wiring. Thus, copper has been noted as a semiconductor wiring material and has found growing application.

For the formation of copper wiring, a sputtering process, CVD process, an electroless plating process and an electroplating process have been employed. Among these processes, the electroplating process has become the most popular technique. This is because the electroplating process can form a deposit at a high rate to give an increased throughput, and can form a deposit at ordinary temperature and pressure that requires an apparatus which is less expensive and which can be handled more easily than that required for the other processes.

Examples of the anode for use in the electroplating process include a soluble copper electrode, and an insoluble electrode comprising Pt-plated titanium. These anodes individually have disadvantages.

In some detail, the use of the soluble copper electrode has the following disadvantages:

(1) In order to obtain uniform dissolution of copper ion, a black film is formed on the surface of the electrode. However, the film comes off to form a powder which is then dispersed in the plating solution. The powder is then incorporated into the thin copper layer to raise the layer resistivity. A suspended powder removing film on the way of the plating solution pipes is clogged up with the powder.

(2) The distribution of the copper wiring thickness on the wafer must be uniform. However, because the surface of the soluble electrode is dissolved ununiformly in thickness during prolonged use, the distance between the electrodes is ill-balanced, thus disturbing the current distribution and hence producing a variation in the thickness of deposit on the wafer.

(3) The soluble electrode continues to be dipped in the plating solution even during replacement of the wafer to be plated. Thus, copper is dissolved even during suspension of electric power, making it difficult to control the copper concentration.

(4) As the copper plate material constituting the soluble electrode, oxygen-free copper or tough pitch copper is used. However, according to JIS H3100, the purity of these materials is 99.96 at the highest. The amount of impurities contaminating the plating solution is as great as 0.5 g per 1.2 tons of copper deposit, calculated based on the assumption that the plating bath has been energized for 1 KAH (kilo-ampere-hour).

On the other hand, when Pt-plated titanium is used as an insoluble electrode, organic additives such as a lubricant, brightener and surface active agent incorporated in the plating solution are decomposed at a high rate because the Pt-plated titanium anode exhibits a high oxygen generation potential. This causes the additives to be consumed in an increased amount. Further, the copper film-forming properties change with time. Moreover, the cell voltage increases, thus raising the requirements of the power unit.

Where a wafer is plated with copper by a conventional copper-plating process, the insoluble electrode can be used with less difficulty than the foregoing soluble copper electrode. However, as discussed the insoluble electrode has various disadvantages, and there is a need to solve the above mentioned problems of the prior art.

SUMMARY OF THE INVENTION

It is therefore an object of the invention to provide a process for copper-plating a wafer using an anode which hardly contaminates the plating solution, causes no disturbance of current distribution due to changes in the shape of the surface of the anode, and causes little oxidative destruction of additives.

The foregoing object of the invention will become apparent from the following detailed description and examples.

In accordance with the invention, the following wafer plating processes are provided to accomplish the foregoing objectives.

(1) A process for copper-plating a wafer which comprises electroplating a wafer with an electrode comprising a corrosion-resistant metal substrate and a coat mainly composed of iridium oxide provided on the substrate as an anode and the wafer as a cathode in a solution containing copper ion.

(2) The copper-plating process according to (1) above, wherein the anode is an insoluble electrode comprising a corrosion-resistant metal substrate and a coat mainly composed of iridium oxide and further containing a metal or metal oxide selected from the group consisting of platinum, tantalum, titanium, niobium and oxides of these metals provided on the substrate.

(3) The copper-plating process according to (1) or (2) above, wherein a neutral membrane or ion exchange membrane is interposed between the anode and the cathode as a separating membrane.

The foregoing insoluble electrode comprising a corrosion-resistant metal substrate and a coat mainly composed of iridium oxide provided on the substrate exhibits an anode potential low enough to prevent the organic components of additives contained in the plating solution from undergoing oxidative destruction during the generation of oxygen and excellent corrosion resistance even under such plating conditions.

DETAILED DESCRIPTION OF THE INVENTION

The present invention will be further described hereinafter.

The substrate having a coat mainly composed of iridium oxide may be a corrosion-resistant metal such as a valve metal (e.g., Ti, Ta, Nb).

The desired electrode can be formed by providing a coat of iridium oxide alone or a mixture or solid solution thereof with an oxide of one or more metals belonging to the platinum or non-platinum group on the foregoing corrosion-resistant substrate. The process for preparing the desired electrode is not specifically limited. Various processes involving thermal decomposition or the like as disclosed in JP-B-46-21884 (The term "JP-B" as used herein means an "examined Japanese patent application") and JP-B-46-3954 may be employed.

The desired electrode can also be formed by applying a mixture or solid solution of iridium oxide with one or more other non-platinum group metals to the corrosion-resistant substrate. The foregoing non-platinum group metal is preferably Ti, Ta or Nb.

The foregoing metal oxide constituting the coat may be a stoichiometric metal oxide as well as a nonstoichiometric metal oxide or oxide having lattice defects.

The preferred range for the amounts of each of metal oxide is as follows.

Ir: 1 to 60 g-metal oxide/$m^2$

Ta: 1 to 50 g-metal oxide/$m^2$

Pt: 1 to 100 g-metal/$m^2$

Ni: 1 to 30 g-metal oxide/$m^2$

Nb: 1 to 40 g-metal oxide/$m^2$

Further, a valve metal layer or a single valve metal oxide or mixed oxide of valve metals may be interposed between the corrosion-resistant substrate and the foregoing oxide layer to enhance the corrosion resistance of the electrode.

The foregoing coat is a catalyst layer having a thickness of from about 1 to 10 $\mu$m. In this arrangement, even when used as an electroplating anode, only the catalyst is liable to be consumed. Thus, the electrode according to the invention shows no change in external dimension during the course of an electroplating operation. This makes it possible to maintain a uniform current distribution over an extended period of time and hence form a wiring deposit on the wafer to a stabilized thickness.

The foregoing insoluble electrode can be applied to a plating bath having a structure without particular limitation such as a horizontal or vertical electroplating bath.

The amount of the anode mainly composed of iridium oxide that is consumed when energized during plating is about 5 mg/KAH or less, which is two orders of magnitude smaller than the concentration of impurities from the soluble electrode (about 500 mg/KAH). Thus, the amount of contaminants from the anode can be considerably reduced.

Further, the electrode according to the invention exhibits an oxygen generation potential of about 500 mV lower than that of a Pt-plated electrode, demonstrating that it has a low capacity of oxidatively destroying the organic components of additives. Further, the low oxygen generation potential also results in the lowering of plating voltage during plating, making it possible to reduce the electric power cost as well. In accordance with the copper plating process of the invention, a neutral membrane or an ion exchange membrane can be interposed between the anode and the cathode as a separating membrane. This reduces the amount of organic components such as animal fats and oils incorporated into the copper plating solution and that are oxidatively destroyed on the surface of the anode. Hence, use of such a membrane can stabilize the concentration of additives in the vicinity of the cathode.

The foregoing neutral membrane may be properly selected from polyethylene membranes, polyester membranes and polypropylene membranes commercially available from Yuasa Corp. and Nakao Filter Media Co., Ltd. depending on the type of the plating bath to which it is applied.

The foregoing ion exchange membrane may be properly selected depending on the intended application. In particular, Nafion 117 (produced by Du Pont Inc.) is preferred.

The present invention will be further described in the following Examples, but the present invention should not be construed as being limited thereto.

EXAMPLES 1 TO 6

Comparative Example 1

Metal oxide mixtures comprising as a main component iridium oxides having the formulation set forth in Table 1 were applied to a Ti plate having a size of 50 mm×50 mm×3 mm to prepare six insoluble electrodes. The thickness of the coat thus formed was about 2 $\mu$m.

The electrode potential and the percent consumption of the coat after 100 hours of energization were then measured at a current density of 10 A/$dm^2$ and 2 A/$dm^2$, respectively. The insoluble electrode thus prepared was used as an anode and a Ti plate was used as a cathode in a plating solution obtained by adding to an ion-exchanged water copper sulfate (commercially available guaranteed reagent), sulfuric acid (reagent grade) and hydrochloric acid such that the copper ion concentration, sulfuric acid concentration and chlorine ion concentration reached 80 g/$dm^3$, 50 g/$dm^3$ and 50 ppm, respectively, and gelatin (reagent grade, produced by Wako Pure Chemical Industries, Ltd.) in a weight proportion of 10 ppm (Examples 1 to 6).

For comparison, electroplating was effected under the same conditions as described above, except with a Pt-plated titanium electrode as an anode (Comparative Example 1).

The results are set forth in Table 1.

TABLE 1

| | Anode (composition molar ratio) | Anode potential (V vsHg/$Hg_2SO_4$) | Percent consumption (mg/KAH) |
|---|---|---|---|
| Example No. 1 | $IrO_2$/Ti | 1.59 | 5.1 |
| Example No. 2 | $IrO_2$—Pt/Ti (3:7) | 1.52 | 3.5 |
| Example No. 3 | $IrO_2$—$Ta_2O_5$/Ti (7:3) | 1.48 | 2.5 |
| Example No. 4 | $IrO_2$—$Ta_2O_5$—$TiO_2$/Ti (7:2:1) | 1.53 | 4.0 |
| Example No. 5 | $IrO_2Ta_2O_5$—$TiO_2$/Ti (6:3:1) | 1.49 | 2.9 |
| Example No. 6 | $IrO_2$—$Ta_2O_5$—$Nb_2O_5$/Ti (5:4:1) | 1.54 | 3.3 |
| Comparative Example 1 | Pt/Ti | 2.04 | 9.8 |

EXAMPLE 7

A 6-inch semiconductor wafer (Si wafer) which had been etched to form a 0.35 $\mu$m wide trench therein was attached to the cathode feed portion of a horizontal facedown plating apparatus. The plating apparatus was filled with the same plating solution as used in Example 1. Using the insoluble electrode of Example 3 as an anode, pulse electroplating was effected at a cathodic current density of 2 A/$dm^2$ and a cycle of 9 seconds for anodic polarization and 1 second for cathodic polarization while the cathode was being rotated at 100 rpm to form a deposit on the wafer to a thickness of 1.5 $\mu$m. After plating was completed, excess copper on the field oxide layer of the water was removed by CMP (Chemical Mechanical Polishing). The wafer was then subjected to low temperature heat treatment at a temperature of 400° C. The specific resistance and impurity concentration of the embedded copper wiring was then measured and analyzed. Further, the concentration of impurities and additives in the plating solution which had been repeatedly used for plating 100 times was measured. The results are set forth in Table 2.

The specific resistance was measured by a four-terminal method, and the impurity concentration in the plating solution was measured by an atomic absorption spectrometry.

EXAMPLE 8

Using the insoluble electrode of Example 3 as an anode, plating was effected under the same conditions as in Example 7 with a neutral membrane having an average pore diameter of 0.05 μm interposed between the anode and the wafer and covering the anode. The specific resistance and impurity concentration of the copper wiring thus formed was then measured and analyzed. Further, the concentration of impurities and additives in the plating solution thus used for plating was measured. The results are set forth in Table 2.

EXAMPLE 9

Plating was effected under the same conditions as in Example 7, except that the insoluble electrode of Example 2 was used as the anode. The specific resistance and impurity concentration of the copper wiring thus formed was then measured and analyzed. Further, the concentration of impurities and additives in the plating solution thus used for plating was measured. The results are set forth in Table 2.

EXAMPLE 10

Plating was effected under the same conditions as in Example 8, except that the insoluble electrode of Example 2 was used as the cathode. The specific resistance and impurity concentration of the copper wiring thus formed was then measured and analyzed. Further, the concentration of impurities and additives in the plating solution thus used for plating was measured. The results are set forth in Table 2.

Comparative Example 2

Plating was effected under the same conditions as in Example 7, except that a soluble copper anode was used. The specific resistance and impurity concentration of the copper wiring thus formed was then measured and analyzed. Further, the concentration of impurities and additives in the plating solution thus used for plating was measured. The results are set forth in Table 2.

Comparative Example 3

Plating was effected under the same conditions as in Example 7, except that the Pt-plated titanium electrode of Comparative Example 1 was used as the anode. The specific resistance and impurity concentration of the copper wiring thus formed was then measured and analyzed. Further, the concentration of impurities and additives in the plating solution used for plating was measured. The results Table 2.

TABLE 2

| | Specific resistance of copper wiring (μΩ · cm) | Impurity content in copper wiring (ppm) | Impurity content in plating solution (ppm) | Additive concentration* (%) |
|---|---|---|---|---|
| Example No. 7 | 1.7 to 2.2 | 12 | 64 | 97.5 |
| Example No. 8 | 1.7 to 2.1 | 10 | 58 | 99.0 |
| Example No. 9 | 1.8 to 2.2 | 18 | 76 | 97.4 |
| Example No. 10 | 1.8 to 2.2 | 14 | 74 | 98.9 |
| Comparative Example No. 2 | 1.8 to 2.3 | 58 | 5,925 | 98.4 |
| Comparative Example No. 3 | 1.8 to 2.2 | 26 | 151 | 96.6 |

*Relative to the value determined during preparation of the plating solution taken as 100%

In accordance with the copper-plating process of the invention, a wafer is plated with copper using as an anode an insoluble electrode obtained by coating a corrosion-resistant substrate such as titanium-based substrate with an iridium oxide-based material. In this manner, the contamination of the plating solution by impurities that lower the electrical conductivity thereof can be substantially inhibited. The deposit thus formed has a reduced impurity concentration. Further, since the anode does not change in shape, there is no change in the deposition rate of copper with time and at every point of plating area as indicated by the thickness of the copper wiring. Moreover, since the anode exhibits a lowered potential and thus exerts little oxidative effect, the additives in the plating solution are not liable to deteriorate. This makes it easy to control the copper concentration during plating to great advantage.

While the invention has been described in detail and with reference to specific embodiments thereof, it will be apparent to one skilled in the art that various changes and modifications can be made therein without departing from the spirit and scope thereof.

What is claimed is:

1. A process for copper-plating a wafer which comprises electroplating a semiconductor wafer having sub-micron trenches etched therein with an electrode comprising a corrosion-resistant metal substrate and a coat mainly composed of iridium oxide provided on the substrate as an anode and the wafer as a cathode in a solution containing copper ion.

2. The copper-plating process according to claim 1, wherein said anode is an insoluble electrode comprising a corrosion-resistant metal substrate and a coat mainly composed of iridium oxide and further containing a metal oxide selected from the group consisting of platinum, tantalum, titanium, niobium and oxides of platinum, tantalum, titanium and niobium provided on the substrate.

3. The copper-plating process according to claim 1, wherein a neutral membrane or ion exchange membrane is interposed between said anode and said cathode as a separating membrane.

4. The copper-plating process according to claim 2, wherein a neutral membrane or ion exchange membrane is interposed between said anode and said cathode as a separating membrane.

5. The copper-plating process according to claim 1, wherein the coat is mainly composed of iridium oxide and further contains a metal selected from the group consisting of titanium, tantalum and niobium.

6. The copper-plating process according to claim 1, wherein the coat is mainly composed of iridium oxide and further contains a metal oxide selected from the group consisting of oxides of platinum, tantalum, titanium and niobium.

7. The copper-plating process according to claim 1, wherein the coat is mainly composed of iridium oxide and further contains a metal selected from the group consisting of titanium, tantalum and niobium a nd a metal oxide selected from the group consisting of oxides of platinum, tantalum, titanium and niobium.

8. The copper-plating process according to claim 1, wherein the corrosion-resistant metal substrate comprises a valve metal.

9. The copper-plating process according to claim 1, wherein a valve metal layer or valve metal oxide or mixed oxide of valve metals is interposed between the substrate and the coat.

10. The copper-plating process according to claim 1, wherein the coat has a thickness of from about 1 to 10 μm.

11. The copper-plating process according to claim 1, wherein the semiconductor wafer is a Si wafer.

12. A copper-plating process which comprises providing a plating bath containing copper ion, an anode comprising a corrosion-resistant metal substrate and a coat mainly composed of iridium oxide provided on the substrate and a cathode comprising a semiconductor wafer having sub-micron trenches etched therein, said anode and cathode being immersed in said plating bath, and passing an electric current through said plating bath to deposit copper on the cathode.

13. The copper-plating process according to claim 12, wherein the coat has a thickness of from about 1 to 10 $\mu$m.

14. The copper-plating process according to claim 12, wherein said anode is an insoluble electrode comprising a corrosion-resistant metal substrate and a coat mainly composed of iridium oxide and further containing a metal or metal oxide selected from the group consisting of platinum, tantalum, titanium, niobium and oxides of platinum, tantalum, titanium and niobium provided on the substrate.

15. The copper-plating process according to claim 12, wherein a neutral membrane or ion exchange membrane is interposed between said anode and said cathode as a separating membrane.

16. The copper-plating process according to claim 12, wherein the coat is mainly composed of iridium oxide and further contains a metal selected from the group consisting of titanium, tantalum and niobium.

17. The copper-plating process according to claim 12, wherein the coat is mainly composed of iridium oxide and further contains a metal oxide selected from the group consisting of oxides of platinum, tantalum, titanium and niobium.

18. The copper-plating process according to claim 12, wherein the coat is mainly composed of iridium oxide and further contains a metal selected from the group consisting of titanium, tantalum and niobium and a metal oxide selected from the group consisting of oxides of platinum, tantalum, titanium and niobium.

19. The copper-plating process according to claim 12, wherein a valve metal layer or valve metal oxide or mixed oxide of valve metals is interposed between the corrosion-resistant metal substrate and the coat.

20. A process for forming embedded copper wiring in a semiconductor wafer, which comprises providing a plating bath containing copper ion, an anode comprising a corrosion-resistant metal substrate and a coat mainly composed of iridium oxide provided on the substrate and a cathode comprising a semiconductor wafer including areas of field oxide and having sub-micron trenches etched therein, said anode and cathode immersed in said plating bath, passing electric current through said plating bath to deposit copper on the cathode, and removing copper from the field oxide of the wafer to recover a semiconductor wafer having embedded copper wiring formed therein.

* * * * *